US011412831B2

(12) United States Patent
Evain et al.

(10) Patent No.: US 11,412,831 B2
(45) Date of Patent: Aug. 16, 2022

(54) JOINT MECHANISM OF AN APPLICATION DEVICE OF A COSMETIC PRODUCT, ASSOCIATED DEVICE, APPLICATION METHOD AND MANUFACTURING METHOD

(71) Applicant: L'OREAL, Paris (FR)

(72) Inventors: Gabriel Evain, Saint Ouen (FR); Pierre Gardet, Saint Ouen (FR); Wendy Annonay, Saint Ouen (FR); Oliver Fargeas, Saint Ouen (FR)

(73) Assignee: L'OREAL, Paris (FR)

( * ) Notice: Subject to any disclaimer, the term of this patent is extended or adjusted under 35 U.S.C. 154(b) by 559 days.

(21) Appl. No.: 15/565,520

(22) PCT Filed: Apr. 15, 2016

(86) PCT No.: PCT/EP2016/058415

§ 371 (c)(1),
(2) Date: Oct. 10, 2017

(87) PCT Pub. No.: WO2016/166327

PCT Pub. Date: Oct. 20, 2016

(65) Prior Publication Data

US 2018/0070701 A1 Mar. 15, 2018

(30) Foreign Application Priority Data

Apr. 15, 2015 (FR) ..... 15 00790

(51) Int. Cl.

| | |
|---|---|
| ***A45D 34/04*** | (2006.01) |
| ***A45D 40/26*** | (2006.01) |
| ***A45D 40/22*** | (2006.01) |

(52) U.S. Cl.
CPC ..... *A45D 34/04* (2013.01); *A45D 40/22* (2013.01); *A45D 40/26* (2013.01); *A45D 40/265* (2013.01); *A45D 2200/1072* (2013.01)

(58) Field of Classification Search
CPC ..... A45D 19/02; A45D 34/04; A45D 40/265; A45D 34/042; A45D 34/045; A45D 40/26;

(Continued)

(56) References Cited

U.S. PATENT DOCUMENTS 245,659 A * 8/1881 Renner ..... B62J 11/00 248/516
2,749,567 A * 6/1956 Krueger ..... A46B 5/0087 15/172

(Continued)

FOREIGN PATENT DOCUMENTS

CN 1524474 A 9/2004
CN 102085042 A 6/2011

(Continued)

*Primary Examiner* — Yogesh P Patel
*Assistant Examiner* — Jennifer Gill
(74) *Attorney, Agent, or Firm* — Polsinelli PC

(57) ABSTRACT

A joint mechanism (12) of an application device (10) of cosmetic product is provided. The joint mechanism (12) comprises a first part (22) having a rib and a second part (24) carrying a bracket receiving the rib. The first part (22) is mobile in rotation with respect to the second part (24) about an axis. One among the first part (22) and the second part (24) comprises at least one protruding pin, and the other among the first part (22) and the second part (24) defines a path for guiding the pin. The pin is inserted into the path for guiding, with the pin and the path for guiding being off-centered with respect to the axis.

19 Claims, 2 Drawing Sheets

(58) Field of Classification Search
CPC ..... A46B 5/0091; A46B 5/0087; Y10T 403/32368; Y10T 403/32377; Y10T 403/32352; Y10T 403/32336; Y10T 403/32319; Y10T 403/32361; Y10T 403/32418
USPC ..... 403/103
See application file for complete search history.

(56) References Cited

U.S. PATENT DOCUMENTS 3,433,510 A * 3/1969 Hulterstrum ..... F16C 11/0619 403/77
4,033,007 A * 7/1977 Hadary ..... A46B 7/02 15/172
4,165,755 A * 8/1979 Cassai ..... A45D 40/265 132/218
4,370,989 A 2/1983 Taylor
4,396,028 A * 8/1983 Waggoner ..... A45D 34/04 15/144.1
4,738,252 A * 4/1988 Friddle ..... A61F 5/0127 403/97
5,240,265 A * 8/1993 Huang ..... B62B 9/104 280/47.4
5,974,618 A * 11/1999 Dumler ..... A46B 5/0075 15/167.1
6,026,823 A * 2/2000 Gueret ..... A45D 34/046 132/218
6,203,511 B1 * 3/2001 Johnson ..... A61F 5/0125 602/16
6,238,124 B1 * 5/2001 Merlo ..... F16C 11/0604 403/93
6,390,483 B1 * 5/2002 Hsu ..... B62K 3/002 280/87.041
6,760,949 B2 * 7/2004 Kaminstein ..... A46B 7/06 15/144.1
7,032,941 B2 * 4/2006 Heneveld ..... A01B 1/225 294/51
7,156,107 B2 * 1/2007 Hsu ..... A46B 3/18 132/309
7,172,357 B2 * 2/2007 Gueret ..... A45D 40/265 15/185
7,429,141 B2 * 9/2008 Habatjou ..... A46B 5/005 401/126
7,487,784 B2 * 2/2009 Gueret ..... A45D 40/267 132/218
7,823,593 B2 * 11/2010 Gueret ..... A45D 40/265 132/218
9,339,098 B2 * 5/2016 Takata ..... A45D 40/265
9,469,499 B1 * 10/2016 Chen ..... B65H 75/48
10,130,155 B2 * 11/2018 Ramet ..... A45D 34/045
10,292,479 B2 * 5/2019 Thiebaut ..... A45D 34/04
2004/0009028 A1 * 1/2004 Gueret ..... A45D 40/265 401/129
2005/0034257 A1 * 2/2005 Ponzini ..... A61C 15/00 15/167.1
2010/0205759 A1 * 8/2010 Dondi ..... A46B 5/0058 15/159.1
2011/0067187 A1 * 3/2011 Pegross ..... A46B 5/0075 15/23
2011/0083289 A1 * 4/2011 Heatley-Adams ... A61C 17/222 15/22.2
2011/0135376 A1 * 6/2011 Weigel ..... A45D 40/24 401/29
2013/0051894 A1 * 2/2013 Lim ..... A45D 40/20 401/88
2014/0016984 A1 * 1/2014 Kim ..... A45D 40/265 401/129
2015/0020835 A1 * 1/2015 Takata ..... A45D 40/265 132/200
2015/0020836 A1 * 1/2015 Ramet ..... A45D 40/262 132/200
2015/0164210 A1 * 6/2015 Lou ..... A46B 9/021 401/129
2015/0366326 A1 * 12/2015 Hauger ..... A46B 7/023 401/122

FOREIGN PATENT DOCUMENTS

CN 102273806 A 12/2011
CN 203841276 U 9/2014
DE 2739694 * 3/1979
EP 2229838 * 9/2010
FR 2976166 * 12/2012 ..... A45D 40/26
FR 2976166 A1 12/2012
JP S51016205 Y 4/1976
KR 20110107224 A 9/2011

* cited by examiner

JOINT MECHANISM OF AN APPLICATION DEVICE OF A COSMETIC PRODUCT, ASSOCIATED DEVICE, APPLICATION METHOD AND MANUFACTURING METHOD

CROSS REFERENCE TO RELATED APPLICATIONS

This application is a National Phase filing under 35 U.S.C. § 371 of PCT/EP2016/058415 filed on Apr. 15, 2016; and this application claims priority to Application No. FR 15 00790 filed in France on Apr. 15, 2015, under 35 U.S.C. § 119. The entire contents of each application are hereby incorporated by reference.

DESCRIPTION

Technical Field

This invention relates to a joint mechanism of an application device of a cosmetic product, comprising a first part having a rib and a second part carrying a bracket receiving the rib, said first part being mobile in rotation with respect to said second part about an axis.

BACKGROUND OF THE DISCLOSURE

The application device is intended to package and to accurately apply a cosmetic product on a surface of the body of a user, such as the skin or the hair of the user.

The cosmetic product is advantageously a makeup or care product such as an eye-liner, a mascara, a gloss or a lipstick. Preferably, the cosmetic product has a fluid form.

More generally, a cosmetic product is a product as defined in EC Regulation No. 1223/2009 of the European Parliament and the Council of Nov. 30, 2009, relating to cosmetic products.

A joint mechanism is known for example in document FR 2976166 A1. This document describes an eye-liner comprising a joint between the handle and a part carrying the application tip. This joint consists of a pin extending between two flanges of the part carrying the application tip.

The joint authorizes a pivoting of the application tip with respect to the handle facilitating the handling and the accuracy of the application.

However, the presence of a pin arranged between the flanges can be seen by the user. This mechanism does not correspond to certain desired aesthetic criteria.

BRIEF SUMMARY OF THE DISCLOSURE

A first solution consists in masking the joint by providing a band comprising an outer skirt extending to below the pin. In such a case, the band then forms an abutment that limits the amplitude of pivoting.

A purpose of the invention is therefore to provide a joint mechanism for an application device of a cosmetic product, that is simple and accurate to use while still having a very satisfactory external appearance.

To this effect, the invention has for object a mechanism of the aforementioned type, wherein one among the first part and the second part comprises at least one protruding pin, and in that the other among the first part and the second part defines a path for guiding the pin, the pin being inserted into the path for guiding, with the pin and the path for guiding being off-centered with respect to the axis.

The mechanism according to the invention can include one or more of the following features, taken alone or in any technically possible combination:

- the path for guiding defines end abutments able to limit the course of the pin in rotation about the axis,
- one among the first part and the second part comprises two opposite pins, located on either side of a plane of displacement of the rib in the bracket, the other among the first part and the second part defining two opposite paths for guiding each receiving one of said pins,
- the path for guiding has the shape of a curved oblong hole about the axis, the axis being located away from the path for guiding.
- the mechanism comprises an angular indexing arrangement of the rib with respect to the bracket in at least one angular position,
- the bracket defines a central slot for receiving the rib having a bottom, with the angular indexing arrangement comprising at least one notch arranged in the bottom of the slot, able to cooperate with complementary reliefs of the rib,
- the first part has an outer skirt arranged around the bracket when the pin is received in the path for guiding, with the bracket protruding at least partially outside of the skirt,
- the skirt defines at least one deformable tab carrying one of the pin and the path for guiding, with the tab being radially deformable with respect to an axis of the skirt in order to allow for the insertion of the pin into the path for guiding,
- the second part comprises a band defining an inner cavity for receiving a receptacle, with the bracket protruding with respect to the band opposite the inner cavity; and
- the first part comprises the or each pin, the or each path for guiding being defined in the bracket.

The invention also has for object an application device of a cosmetic product, comprising:

- a rod carrier and an applicator carried by the rod carrier;
- a gripping member;
- a joint mechanism such as defined hereinabove, with the first part being integral in rotation with the gripping member, with the second part being integral in rotation with the rod carrier, the rod carrier being mounted mobile in rotation with respect to the gripping member about the axis by the intermediary of the joint mechanism.

The device according to the invention can include one or more of the following features, considered alone or in any combination that is technically possible:

- the device comprises a receptacle containing cosmetic product, with the rod carrier able to switch from a storage configuration inserted in the receptacle to a configuration for applying cosmetic product, arranged outside of the receptacle; and
- the gripping member is formed by an elongated cap mounted around the first part.

The invention also has for object a method for applying cosmetic product on a surface of the body of a user including the following steps:

- supplying of a device such as defined hereinabove, with the rod carrier and the gripping member occupying a first relative angular position about the axis;
- pivoting of the gripping member with respect to the rod carrier, to displace them in a second relative angular position about the axis, with the pin circulating in the path for guiding in order to guide the pivoting; and
- application of the cosmetic product on the body surface.

The invention also has for object a method for mounting a joint mechanism of an application device of cosmetic product, including the following steps:

supplying of a first part having a rib and a second part carrying a bracket, inserting of the rib into the bracket, with the rib being mounted mobile in rotation about a pivot axis, wherein one among the first part and the second part comprises at least one protruding pin, and the other among the first part and the second part defines a path for guiding, the pin being inserted into the path for guiding during the inserting of the rib into the bracket, with the pin and the path for guiding being off-centered with respect to the axis.

BRIEF DESCRIPTION OF THE DRAWINGS

The invention will be easier to understand in view of the following description, provided solely as an example and with reference to the appended drawings, wherein.

DETAILED DESCRIPTION OF THE DISCLOSURE

Figure 1:
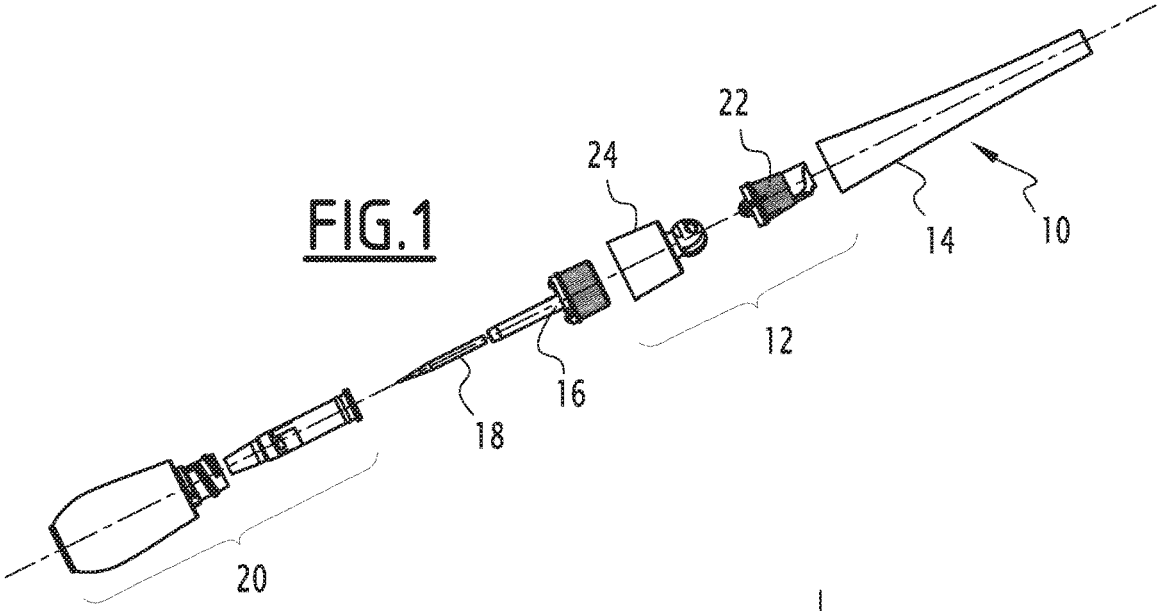
FIG. 1 is an exploded view of an application device, comprising a joint mechanism according to the invention.

A first device 10 according to the invention is shown in FIG. 1.

The device 10 is intended to condition a cosmetic product and to apply the cosmetic product on a body surface of a user, for example on the skin, or a keratin fiber of a user.

The cosmetic product is advantageously a makeup or care product such as an eye-liner, a mascara, a gloss or a lipstick. Preferably, the cosmetic product has a fluid form.

Figure 2:
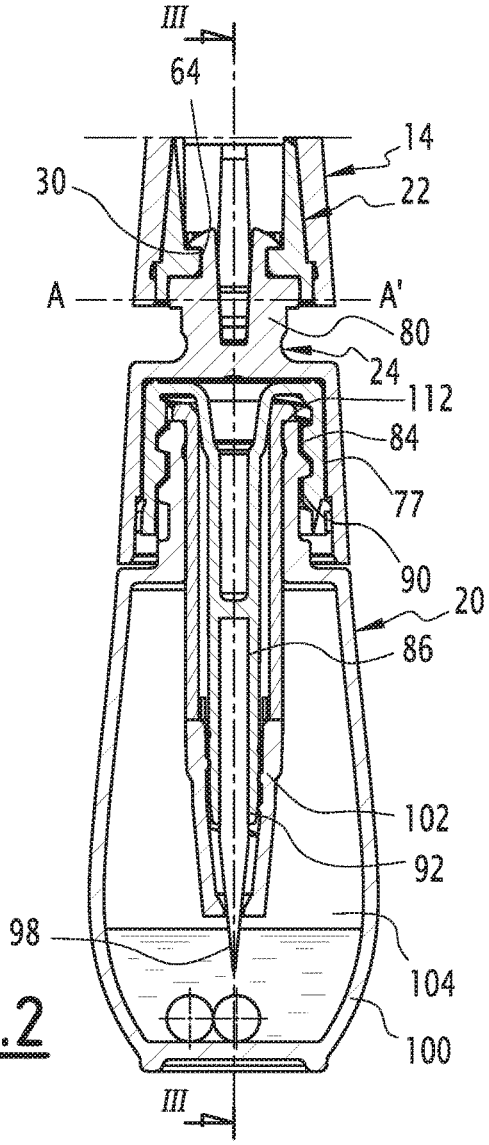
FIG. 2 is a transverse cross-section view of the device of FIG. 1.
Figure 3:
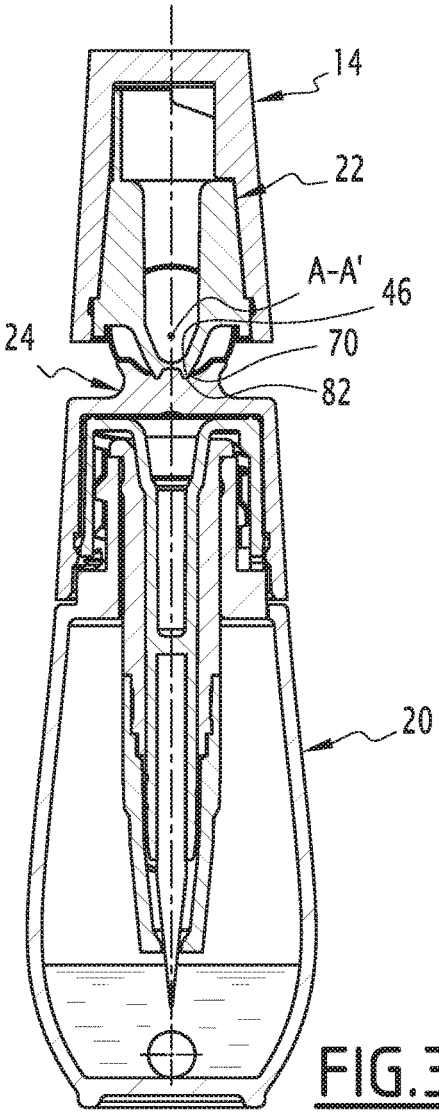
FIG. 3 is a cross-section view according to a plane III-III perpendicular to the cutting plane of FIG. 2 of the device shown in FIG. 2.

The device 10 shown in FIGS. 1, 2 and 3 comprises a gripping member 14, a rod carrier 16 carrying an applicator 18 and a joint mechanism 12 connecting the gripping member 14 to the rod carrier 16. The device 10 further comprises a receptacle 20, wherein the rod carrier 16 and the applicator 18 are intended to be introduced.

The joint mechanism 12 comprises a first part 22 mobile jointly in rotation with the gripping member 14 and a second part 24 mounted mobile jointly in rotation with the rod carrier 16, with the first part 22 and the second part 24 being mounted mobile in rotation in relation to one another about an axis A-A'.

Figure 4:
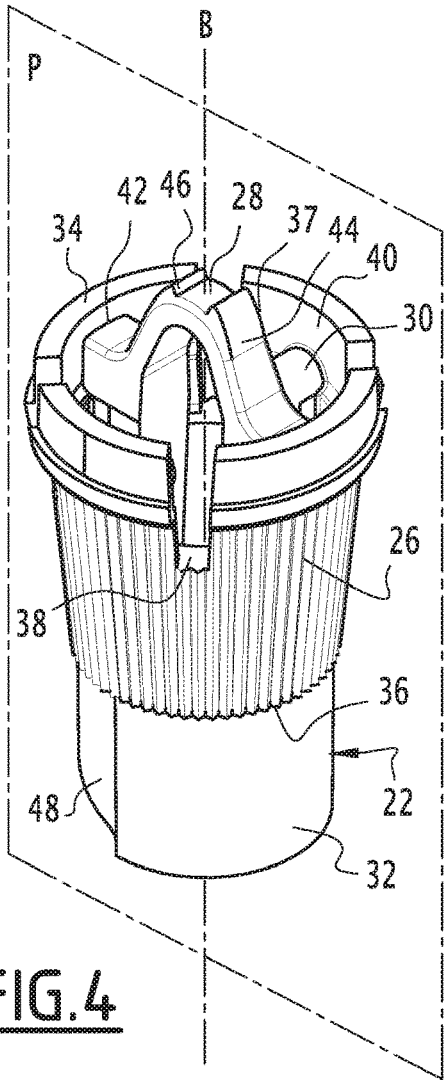
FIG. 4 is a perspective view of the first part of the joint mechanism of the device shown in FIGS. 2 and 3.

The first part 22, in particular shown in FIG. 4, comprises an outer skirt 26, a rib 28 mounted in the center of the skirt 26, at least one protruding joint pin 30 and an upper portion 32.

The outer skirt 26 extends between a free edge 34 and an upper edge 36 about a main axis B. The skirt 26 moves away from the axis B between the upper edge 36 and the free edge 34. Alternatively, the skirt 26 is substantially a cylinder about the axis B.

The skirt 26 is hollow and delimits an inner surface 37.

The skirt 26 defines notches 38. These notches 38 exit on its free edge 34. The skirt 26 comprises for example four notches 38. The notches 38 of the skirt 26 define in between at least one deformable tab 40. The deformable tab 40 is able to be moved away from and/or brought closer to the axis B.

The rib 28 protrudes outside of the outer skirt 26 beyond the free edge 34.

The rib 28 here has two ends 42 linked to the inner surface 37 of the skirt 26 and located on either side of the skirt 26. The two ends 42 are connected by a protruding portion 44, for example substantially in the shape of an arc or of a parabola.

The rib 28 extends substantially along a median plane P of the skirt 26 comprising the axis B.

In the embodiment shown, the rib 28 comprises an inner recess and can be deformed in the event of pressure exerted on its protruding portion 44. The recess facilitates the deformation of the rib according to the material used. Alternatively, the rib can be full while still remaining deformable. In particular, the deformation varies according to the resulting thickness between the protruding portion and the inner recess of the rib 28.

The rib 28 defines on the protruding portion at least one indexing relief 46, of which the function shall be described hereinbelow. The relief 46 comprises at least one tooth.

The joint pin 30 extends to the axis B from the inner surface 37 of the skirt 26. The joint pin 30 is carried by a deformable tab 40. It has a general cylindrical shape with an axis substantially perpendicular to the tangent to the inner surface 37 of the skirt 26 on the pin 30.

The joint pin 30 does not pass through the plane P wherein the rib 28 extends.

Each joint pin 30 extends parallel to the axis A-A'. The joint pins 30 are transversally offset in relation to the axis A-A'.

The first part 22 advantageously comprises two opposite pins 30. The joint pins 30 are located on either side of the plane P along which extends the rib 28. The pins 30 are here located substantially at an equal distance from the two ends 42 of the rib 28.

The pins 30 are each carried by a different deformable tab 40.

The upper portion 32 extends from the upper edge 36 of the skirt 26. It has the general shape of a cylinder, of axis confounded with the axis B, comprising a slot 48. The slot 48 in particular guides the introduction of the gripping member 14. The slot 48 provides an indexing of the gripping member during assembly.

Figure 5:
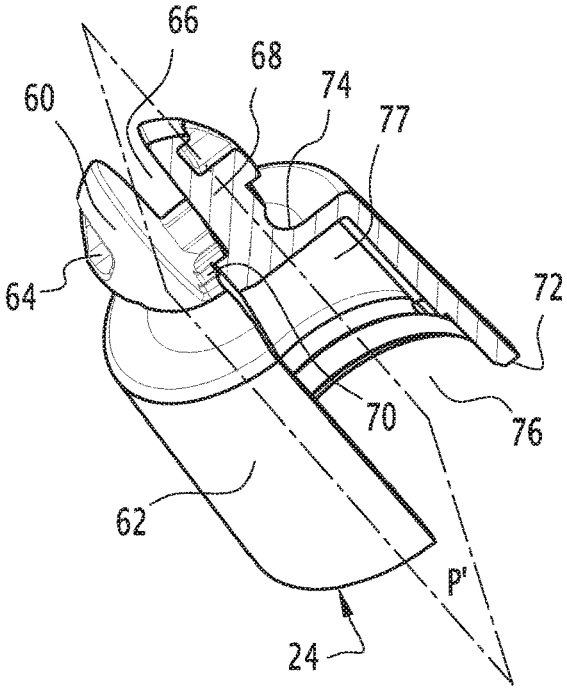
FIGS. 5 and 6 are respectively perspective and side views of the second part of the joint mechanism shown in FIGS. 2 and 3.
Figure 6:
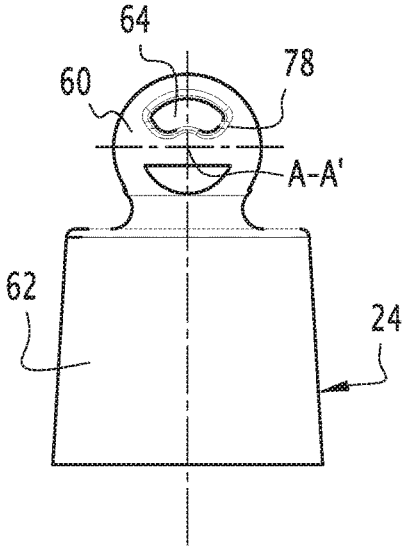

The second part 24, shown in particular in FIGS. 5 and 6, comprises, from bottom to top in FIG. 5, a bracket 60 for receiving the rib 28, and a band 62 for mounting the rod carrier. It defines at least one path for guiding 64 the joint pin 30.

The bracket 60 delimits a central slot 66, having a complementary shape of the rib 28 of the first part 22. The central slot 66 extends along a plane P'.

The bracket 60 here comprises two lateral flanges 68 separated by a space forming the slot 66. The bracket 60 substantially has the shape of a ball. The plane of the slot 66 passes through the center of the ball.

The central slot 66 has a bottom. The bottom comprises at least one notch 70 for cooperating with the indexing relief 46. Each notch 70 is complementary with a relief 46 of the rib 28.

The band 62 extends between a free edge 72 and an edge linked 74 to the bracket 60, intended to be placed opposite the free edge of the skirt 26.

The band 62 defines an inner cavity 76 for insertion of the rod carrier, delimited by an inner surface 77. The band 62 has for example substantially the shape of a hollow cylinder closed at its edge linked 74 to the bracket 60, by the intermediary of a support plate of the bracket 60.

The bracket 60 protrudes with respect to the band 62 on the support plate, opposite the inner cavity 76.

In reference to FIG. 6, the path for guiding 64 is arranged in the bracket 60 in the lateral flange 68 of the bracket.

The second part 24 has the same number of paths for guiding 64 as the first part 22 has pins 30.

The path for guiding 64 defines end abutments 78, which can be seen in FIG. 6, able to limit the course of the pin 30 that it receives.

The path for guiding 64 is here a curved hole centered around the axis A-A', having a constant width that corresponds to the width of the pin 30. The axis A-A' is for example closer to the band 62 than the path for guiding 64.

The angular extent of the path for guiding 64 about the axis A-A' corresponds substantially to the desired course of the first part 22 with respect to the second part 24 in rotation about the axis A-A'.

Figure 7:
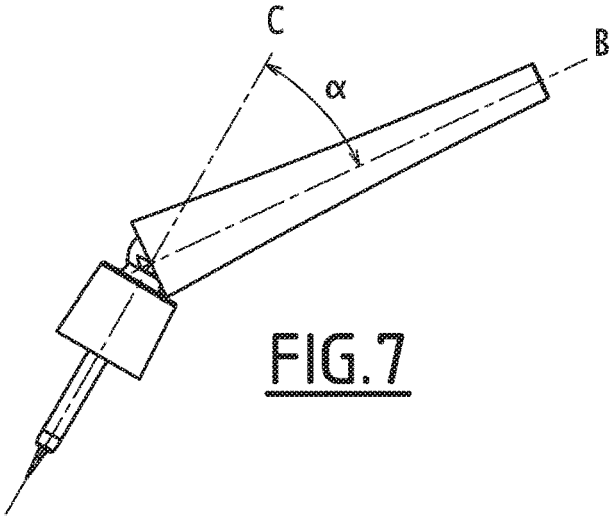
FIG. 7 is a diagrammatical views of the device comprising a joint mechanism according to an embodiment, after modification of the angle between the first part and the second part.

The maximum angle a between the first part 22 and the second part 24, at the end of travel of the pin 30 in the path for guiding 64 shown in FIG. 7, is for example less than 40°, and is in particular between 15° and 40°, and is particularly equal to 35°.

The shape of the path for guiding 64 is complementary with the trajectory swept by the pin 30 in the bracket 60 during a displacement of the first part 22 with respect to the second part 24.

This shape is here substantially a shape of a bean or an oblong hole with a trajectory coaxial to the axis A-A'.

The joint mechanism 12 is formed from the assembly of the first part 22 and of the second part 24.

The rib 28 of the first part 22 is received in the slot 66 of the bracket 60 of the second part 24. The plane P of the rib 28 and the plane P' of the central slot 66 for receiving are then substantially confounded. Each pin 30 is received in a corresponding path for guiding 64.

The skirt 26 of the first part 22 is then arranged around the bracket 60 of the second part 24. The bracket 60 protrudes at least partially outside of the skirt 26, for example on a portion 80 of the bracket 60 in contact with the band 62. As such, the shape of the bracket 60 can be seen, which improves the aesthetic appearance and the clearance in rotation of the first part 22 with respect to the second part 24.

The first part 22 and the second part 24 are mobile in rotation with respect to one another about the axis A-A'.

In the example shown in the figure, the joint mechanism 12 comprises an angular indexing arrangement 82 of the rib with respect to the bracket, which can be seen in FIG. 3. The angular indexing arrangement 82 comprises the reliefs 46 of the rib 28 and the notches 70 arranged at the bottom of the bracket 60 that cooperates with the reliefs 46.

The angular indexing arrangement 82 comprises for example at least three indexing positions of the first part 22 with respect to the second part 24, with each position being characterized by the presence of a particular relief 46 in a given notch 70.

The passing from one position of the angular indexing arrangement 82 to another is carried out by a rotation of the rib 28 in the bracket 60 and by displacement of the pin 30 in the path for guiding 64. During the passing from one position to another, the inner recess facilitates a deformation of the rib 28 in order to allow for the passage of the relief 46.

Two of the three indexing positions advantageously correspond to the configurations wherein each pin 30 is located on an end abutment 78 of the corresponding path for guiding 64. The third position corresponds to a median position of the pin 30 within the path for guiding 64.

The angular indexing arrangement 82 maintains the rib 28 in a position within the bracket 60. In order to pass from one indexing position to another, a user is able to manually exert a force of displacement that makes it possible to modify the angular position of the rib 28 within the bracket 60. The angular indexing arrangement 82 has however an anti-return function when the pin 30 is located on one end abutment 78 of the corresponding path for guiding 64.

The gripping member 14 is intended to be gripped by a user. The gripping member 14 is for example an elongated cap along a main axis confounded with the axis B. In an embodiment, a portion of the surface of the gripping member 14 is anti-skid.

The gripping member 14 is mounted integral in rotation with the first part 22. The gripping member is, for example, fixed by gluing.

The gripping member 14 has a cavity receiving the first part 22. It covers the upper portion 32 and, at least partially, the skirt 26 of the first part 22.

When the skirt 26 is provided with notches 38, defining at least one deformable tab 40, the cavity of the gripping member 14 has a shape complementary with the outer surface of the upper portion 32 and with at least one portion of the skirt 26, when the deformable tab or tabs 40 are brought closer to the axis B.

In reference to FIG. 2, the rod carrier 16 comprises a fastening portion 84 and a bearing member 86.

The rod carrier 16 is integral in rotation with the second part 24. The fastening portion 84 is of complementary shape with the inner cavity 76 defined by the band 62.

The fastening portion 84 has an inner surface 90 forming for example a thread pitch that can be engaged on the receptacle.

Here, the rod carrier 16 provides the closing of the receptacle. Alternatively, according to the configuration of the rod carrier 16, the closing function of the receptacle 20 can be carried out directly by the band 62, then having a threading that can be engaged with the receptacle 20.

The carrying member 86 extends from the fastening portion 84. It has a free end 92 from which the applicator 18 extends. The applicator 18 extends along a main axis C.

The applicator 18 is partially inserted into the carrying member 86. It comprises an outer active portion 98 that makes it possible to apply the product. Alternatively, the applicator 18 is fully inserted into the carrying member 86 of the rod carrier 16 and a mechanism makes it possible to exit a portion of the applicator 18 of the rod carrier 16, for example a push mechanism.

The applicator 18 is for example an eye-liner tip, a mascara tip or a foam tip for gloss.

The gripping member 14 and the rod carrier 16 carrying the applicator 18 are mounted on either side of the joint mechanism 12. The gripping member 14 and the rod carrier 16 are mounted mobile in rotation about the axis A-A' by the intermediary of the joint mechanism 12.

In this example, there is a position of the angular indexing arrangement 82 such as the axes C and B are confounded. In the event where there are three possible positions of angular indexing arrangement, two of which correspond to end abutments 78 of the path for guiding 64, the position for which the axes C and B are confounded is the median position.

The receptacle 20 comprises a bottle 100 and a squeezing device 102.

The bottle 100 defines a volume 104 for receiving cosmetic product, which opens via a neck 112.

The neck 112 comprises a complementary thread pitch with respect to the thread pitch of the rod carrier 16. The receptacle 20 can be made integral with the rod carrier 16 in a removable manner.

The rod carrier 16 is as such able to pass from a storage configuration, by being inserted in the receptacle 20, to a configuration for applying cosmetic product, by being arranged outside of the receptacle 20.

The squeezing device 102 is fixed to the bottle 100 on the neck 112.

During the removal of the rod carrier 16, the applicator 18 is substantially in contact with the squeezing device 102 so as to remove the excess product that it is carrying.

A method for mounting a joint mechanism 12 according to the invention will now be described.

The first part 22 having a rib 28 and the second part 24 carrying a bracket 60 are provided. The first part 22 comprises at least one protruding joint pin 30 and the second part 24 defines a path for guiding 64 the pin 30.

The first part 22 and the second part 24 are aligned. The rib 28 is then inserted into the bracket 60.

During the inserting of the rib 28 into the bracket 60, the pin 30 enters into the path for guiding 64. The pin 30 and the path for guiding 64 are off-centered with respect to the axis A-A'. The pin 30 is mobile along the path for guiding 64.

The deformable tab 40 moves away by elastic deformation from the axis B from the skirt 26 for the insertion of the pin 30 into the path for guiding 64, then returns to its configuration once inserted. Alternatively, the deformable tab 40 is initially spaced from the axis of the skirt 26 in order to allow for the insertion of the pin 30 into the path for guiding 64, and is tightened once the pin 30 is inserted in the path for guiding 64 so that the pin 30 is maintained in the path for guiding 64.

The gripping member 14 is then mounted around the first part 22, by leaving the rib 28 still accessible. The gripping member 14 maintains the pin 30 within the path for guiding 64, by preventing the radial deformation of the tab 40.

The mechanism 12 is then functional.

A method of applying cosmetic product with an application device 10 of cosmetic product implementing a joint mechanism 12, such as described hereinabove, will now be described.

Initially, an application device 10 such as described hereinabove is provided. The main axis of the gripping member 14 is substantially confounded with the axis B of the skirt. The axis of the applicator 18 and the axis of the gripping member B are in a first relative angular position about the pivot axis, by being aligned in relation to one another.

The aesthetic appearance of the application device 10 is very satisfying.

The user removes the unit formed by the gripping member 14, the joint mechanism 12, the rod carrier 16 and the applicator 18 of the receptacle 20. The applicator 18 passes through the squeezing device 102, causing the squeezing of the product.

Then, the user pivots the gripping member 14 with respect to the rod carrier 16 by surmounting the retaining force supplied by the indexing arrangement. The pin 30 is displaced in the path for guiding 64 in order to guide the pivoting. The angle a between the rod carrier 16 and the gripping member 14 is as such modified. The gripping member 14 and the rod carrier 16 are then in a second relative angular position about the pivot axis, wherein the axis C of the applicator 18 and the axis B of the gripping member 14 are inclined by a non-zero angle $\alpha$.

The user applies the cosmetic product on the provided body surface using the applicator, which is made simple thanks to the relative inclination between the axes B and C.

In an alternative (not shown), the second part 24 comprises at least one pin 30 and the first part 22 comprises at least one path for guiding 64. The pin 30 is for example carried by the bracket 60 and the path for guiding 64 is defined in the outer skirt 26 on a deformed tab 40.

The invention claimed is:

1. A cosmetic product application device, comprising:

a rod carrier and an applicator carried by the rod carrier;

a gripping member;

a joint mechanism comprising a first part having a rib and a second party carrying a bracket receiving the rib, the first part being rotatable with respect to the second part about an axis (A-A'), wherein one among the first part and the second part comprises at least one protruding pin, and in that the other among the first part and the second part defines a path for guiding the pin, the pin being adapted to circulate in the path for guiding during the rotation in order to guide the rotation, with the pin protruding in a direction parallel to the axis, extending parallel to the axis, and being transversely offset in relation to the axis, the axis being located away from the path for guiding, the joint mechanism being devoid of any pin parallel to the axis and centered on the axis; with the first part rotating with the gripping member, with the second part rotating with the rod carrier, the rod carrier being mounted mobile in rotation with respect to the gripping member about the axis (A-A') by the intermediary of the joint mechanism.

2. A method for applying cosmetic product on a surface of a body of a user, including the following steps:

supplying a device according to claim 1, with the rod carrier and the gripping member occupying a first relative angular position about the axis (A-A');

pivoting the gripping member with respect to the rod carrier, to displace them in a second relative angular position about the axis (A-A'), with the pin circulating in the path for guiding during the rotation in order to guide the pivoting;

application of cosmetic product on the body surface.

3. A method for mounting a joint mechanism of an application device of cosmetic wherein the application device comprises: a rod carrier and an applicator carried by the rod carrier; and a gripping member; wherein the joint mechanism comprises a first part having a rib and a second part carrying a bracket receiving the rib, said first part being rotatable with respect to said second part about an axis (A-A'), wherein one among the first part and the second part comprises at least one protruding pin, and the other among the first part and the second part defines a path for guiding the pin, the pin being adapted to circulate in the path for guiding during the rotation in order to guide the rotation, with the pin protruding in a direction parallel to the axis extending parallel to the axis and being transversally offset in relation to the axis, the axis being located away from the path for guiding, the mechanism being devoid of any pin parallel to the axis and centered on the axis, and wherein the method includes the following steps:

supplying the first part with the rib and the second part with the bracket, inserting of the rib into the bracket, with the rib being mounted mobile in rotation about a pivot axis (A-A'), the pin being inserted into the path for guiding during the inserting of the rib into the bracket, with the pin and the path for guiding being off-centered with respect to the axis (A-A').

4. The cosmetic product application device of claim 1, wherein the path for guiding defines end abutments able to limit the course of the pin during the rotation about the axis (A-A').

5. The cosmetic product application device of claim 1, wherein the at least one protruding pin comprises two opposite pins on the second part, the two opposite pins being located on either side of a plane of displacement of the rib in the bracket, the path for guiding comprising two opposite paths on the first part, each of the two opposite paths receiving one of the two opposite pins.

6. The cosmetic product application device of claim 1, wherein the path for guiding has the shape of a curved oblong hole about the axis (A-A').

7. The cosmetic product application device of claim 1, comprising an angular indexing arrangement of the rib with respect to the bracket in at least one angular position.

8. The cosmetic product application device of claim 1, wherein the bracket defines a central slot for receiving the rib, the slot having a bottom, with the angular indexing arrangement comprising at least one notch arranged in the bottom of the slot, able to cooperate with complementary reliefs on the rib.

9. The cosmetic product application device of claim 1, wherein the first part has an outer skirt arranged around the bracket when the pin is received in the path for guiding, with the bracket protruding at least partially outside of the skirt.

10. The cosmetic product application device of claim 1, wherein the skirt defines at least one deformable tab carrying one of the pin and the path for guiding, with the tab being radially deformable with respect to an axis of the skirt in order to allow for the insertion of the pin into the path for guiding.

11. The cosmetic product application device of claim 1, wherein the second part comprises a band defining an inner cavity for receiving a receptacle, with the bracket protruding with respect to the band opposite the inner cavity.

12. The cosmetic product application device of claim 1, wherein the first part comprises the at least one pin, with the path for guiding being defined in the bracket.

13. The cosmetic product application device according to claim 1, further comprising a receptacle containing the cosmetic product, wherein the rod carrier is able to switch from a storage configuration inserted in the receptacle to a configuration for applying cosmetic product, arranged outside of the receptacle.

14. The cosmetic product application device according to claim 1, wherein the gripping member is formed by an elongated cap mounted around the first part.

15. The cosmetic product application device of claim 1, wherein the at least one protruding pin comprises two opposite pins on the first part, the two opposite pins being located on either side of a plane of displacement of the rib in the bracket, the path for guiding comprising two opposite paths on the second part, each of the two opposite paths receiving one of the two opposite pins.

16. The cosmetic product application device according to claim 4, wherein the path for guiding has the shape of a curved oblong hole about the axis (A-A').

17. The cosmetic product application deviceaccording to claim 5, wherein the path for guiding has the shape of a curved oblong hole about the axis (A-A').

18. The cosmetic product application deviceaccording to claim 4, comprising an angular indexing arrangement of the rib with respect to the bracket in at least one angular position.

19. The cosmetic product application deviceaccording to claim 5, comprising an angular indexing arrangement of the rib with respect to the bracket in at least one angular position.

* * * * *